US011259598B2

(12) United States Patent
Avecilla

(10) Patent No.: US 11,259,598 B2
(45) Date of Patent: Mar. 1, 2022

(54) DUAL USE SHOE

(71) Applicant: Melody Avecilla, Studio City, CA (US)

(72) Inventor: Melody Avecilla, Studio City, CA (US)

( * ) Notice: Subject to any disclaimer, the term of this patent is extended or adjusted under 35 U.S.C. 154(b) by 705 days.

(21) Appl. No.: 16/056,950

(22) Filed: Aug. 7, 2018

(65) Prior Publication Data

US 2019/0037965 A1 Feb. 7, 2019

Related U.S. Application Data

(63) Continuation-in-part of application No. 29/618,297, filed on Sep. 20, 2017, now Pat. No. Des. 874,116.

(60) Provisional application No. 62/541,878, filed on Aug. 7, 2017.

(51) Int. Cl.

| | |
|---|---|
| ***A43B 21/433*** | (2006.01) |
| ***A43B 21/50*** | (2006.01) |
| ***A43B 3/24*** | (2006.01) |
| ***A43B 21/48*** | (2006.01) |
| ***A43B 13/14*** | (2006.01) |

(52) U.S. Cl.

CPC ..... *A43B 21/433* (2013.01); *A43B 3/246* (2013.01); *A43B 13/14* (2013.01); *A43B 21/48* (2013.01); *A43B 21/50* (2013.01)

(58) Field of Classification Search

CPC ..... A43B 21/50; A43B 21/36; A43B 21/48; A43B 21/26; A43B 21/00; A43B 3/24

See application file for complete search history.

(56) References Cited

U.S. PATENT DOCUMENTS

| | | | | |
|---|---|---|---|---|
| 2,767,489 | A | 10/1956 | Sturman | |
| 5,309,651 | A * | 5/1994 | Handel | A43B 21/433 36/100 |
| D633,288 | S | 3/2011 | Shin | |
| 8,112,908 | B2 | 2/2012 | Visser | |
| 8,281,503 | B2 | 10/2012 | Savill, Jr. | |
| 8,322,053 | B2 | 12/2012 | Handel et al. | |
| 9,289,025 | B2 | 3/2016 | Damodar | |
| 9,936,761 | B2 | 4/2018 | Alan | |
| 10,045,591 | B2 | 8/2018 | Isinhue et al. | |

(Continued)

FOREIGN PATENT DOCUMENTS

| | | | |
|---|---|---|---|
| CN | 204653917 | U | 9/2015 |
| CN | 205585433 | U | 9/2016 |
| WO | 2013088113 | A2 | 6/2013 |

OTHER PUBLICATIONS

"Camileon Heels—Engineered Retractable Heel." Found online Jan. 30, 2020 at www.designdesginonline.com. Page archived Oct. 9, 2014. Retrieved from URL: https://web.archive.org/web/20141009181655/http://www.designdesignonline.com/product/camileon_heel.html (Year: 2014).

(Continued)

*Primary Examiner* — Jillian K Pierorazio

(74) *Attorney, Agent, or Firm* — Fennemore Craig, P.C.

(57) ABSTRACT

A dual use women's shoe has a pivoting heel assembly. The heel assembly has a housing and a heel piece. pivoting is controlled by use of a two stage bayonet latch that may be selectively manipulated to convert the shoe between a ladies court style with the heel fully extended as a high heel and another style of lesser height with the heel piece in a retracted positon down beneath the sole. The other style may be a wedge, loafer, mule or sandal. The heel assembly may include with a spring that biases the heel piece towards the fully extended high heel configuration, such that the retracted heel piece in the retracted configuration springs into the fully extended high heel configuration when a button of the bayonet latch is depressed.

38 Claims, 9 Drawing Sheets

(56) References Cited

U.S. PATENT DOCUMENTS

| | | | | |
|---|---|---|---|---|
| 10,426,217 | B1 | 10/2019 | Mainolfi et al. | |
| 2007/0289167 | A1 | 12/2007 | Pieriboni | |
| 2010/0071233 | A1 | 3/2010 | Savill, Jr. | |
| 2010/0083537 | A1* | 4/2010 | Wierda | A43B 3/24 36/100 |
| 2012/0085000 | A1 | 4/2012 | Alaimo | |
| 2014/0298685 | A1* | 10/2014 | Alan | A43B 21/48 36/100 |
| 2015/0113837 | A1* | 4/2015 | Isinhue | A43B 21/42 36/34 R |
| 2015/0264994 | A1* | 9/2015 | Guardado | A43B 21/22 36/100 |
| 2016/0198795 | A1* | 7/2016 | Lopez-Velasquez | A43B 21/42 36/100 |
| 2017/0095029 | A1* | 4/2017 | Berberian | A43B 13/28 |

OTHER PUBLICATIONS

"Fashionable Comfort Available This Christmas." Found online Jan. 30, 2020 at prnewswire.com. Page dated Dec. 19, 2019. Retrieved from URL: https://tinyurl.com/wbj964t (Year: 2019).

"Indiegogo—Runway Heels: World's First Retractable High Heels." Found online Jan. 30, 2020 at www.indiegogo.com. Project launched Nov. 7, 2017. Retrieved from URL: https://www.indiegogo.com/projects/runway-heels-world-s-first-retractable-high-heels#/updates/all (Year: 2017).

"Industry's First Retractable High Heels." Found online Jan. 30, 2020 at www.swomag.com. Page dated Nov. 15, 2017. Retrieved from URL: https://www.swomag.com/industrys-first-retractable-high-heels/ (Year: 2017).

"Sheila Driving Shoe makes high-heel and toeing a reality." Found online Jan. 30, 2020 at www.autoblog.com. Page dated Jun. 18, 2007. Retreived from URL: https://www.autoblog.com/2007/06/18/sheila-driving-shoe-makes-high-heel-and-toeing-a-reality/ (Year: 2007).

"YouTube—Runway Heels—For the Modem Woman on the Go." Found online Jan. 30, 2020 at www.youtube.com. Video published Oct. 26, 2017. Retrieved from URL: https://www.youtube.com/watch?v=5B5vZ2zTX7M (Year: 2017).

Office Action dated Feb. 4, 2020 for Design U.S. Appl. No. 29/659,185.

PCT International Search Report and Written Opinion, corresponding to PCT Application No. PCT/US2018/045556, fated Octover 12, 2018, 11 pages.

* cited by examiner

DUAL USE SHOE

RELATED APPLICATIONS

The present application claims benefit of priority to U.S. provisional patent application Ser. No. 62/541,878 filed Aug. 7, 2017 and is a continuation-in part of U.S. design application No. 29/618,297 filed Sep. 20, 2017, both of which are hereby incorporated by reference to the same extent as though fully replicated herein.

BACKGROUND

Field

The presently disclosed instrumentalities relate to women's footwear and, more particularly, high-heel shoes with a heel that may be collapsed into a walking heel.

Description of the Related Art

Women's footwear are an integral part of fashion. Both high heels and flats are widely used. Most women prefer to have both styles of shoes for different occasions. United States patent publication 2015/0113837 to Isinhue et al. shows a dual use women's shoe that has a pivoting heel, such that a single shoe may be placed into a high-heeled configuration or, alternatively, that of an intermediate heel. The intermediate heel is positioned directly atop the extended heel piece in the high heel configuration. It is problematic that the intermediate heel may wear and so also affect dimensional tolerances with resulting play in the extended heel. The pivot mechanism is also difficult to operate.

United States patent publication 2015/0096197 to Salinas shows another dual use shoe. In this case, the heel piece that is used for extension pivots up and under the walking heel. Here the walking heel is not concealed, which is problematic in the sense that wear on the walking heel is unsightly in the high heel configuration. The pivot mechanism is also cumbersome to use. Similarly, WO2006037143 to Pircher shows a dual use shoe where the walking heel for the flat configuration is visible in the extended position.

SUMMARY

The presently disclosed instrumentalities overcome the problems noted above and advance the art by providing a dual use shoe with a heel mechanism that is easy to operate. Also, where the ground contacting surfaces of the heel may be subject to unsightly wear, various heel pivoting configurations are able to hide or conceal the top caps or ground-contacting surfaces heel of the heel.

According to one embodiment, the dual use shoe includes a sole. An upper is connected to the sole. The upper conforms to contours of a human foot that is to be received within the upper when the shoe is worn, and the upper also retains the shoe on the foot of a wearer. The shoe includes a heel assembly made of a housing that is attached to the sole. The housing has a receptacle formed therein. The heel assembly also includes a heel piece having a first section that resides proximate the housing and a second section remote from the housing. A pivot-latch mechanism joints the first section of the heel piece to the housing such that the pivot-latch mechanism may be selectively manipulated for pivoting of the heel piece between: (1) a radially inboard position where the heel piece is rotated and locked into a retracted configuration proximate the sole such that the heel piece dominantly resides within the receptacle; and (2) a radially outboard position where the heel piece is rotated away from the sole into an extended high heel configuration such that the heel piece resides dominantly out of the receptacle.

In one aspect, the shoe may be a women's shoe that, in the extended high heel configuration, is manufactured in a style known as a women's court shoe. This same shoe in the retracted configuration is of a lower height than the high heel configuration. The shoe in the retracted configuration may be that of a wedge, loafer, mule, or sandal. The shoe in the extended high configuration may be that of a ladies court shoe.

In one aspect, the sole may present an elongate central axis running from a toe of the shoe to the heel assembly. The heel piece may also present an axis of elongation running from the first section to the second section. In this case, the pivot-latch mechanism may permits pivoting of the heel piece in a plane that is approximately parallel to the elongate central axis and the axis of elongation.

In one aspect, the pivot latch mechanism may be a two stage bayonet latch. The bayonet latch may have a button for manual manipulation of the pivot-latch mechanism. The button may, for example, protrude from a side of the housing such as a lateral side and or proximal side of a human foot when the shoe is being worn. The button is preferably on the lateral side to prevent accidental depression of the button as may occur by a wearer clicking the facing proximal portions of right and left heels.

In one aspect, the pivot latch mechanism includes a spring that biases the heel piece into the extended high heel configuration such that spring rotates the heel piece into the extended high heel configuration after the button is depressed when the heel piece resides in the retracted configuration.

In one aspect, the heel piece has a pair of top caps positioned for contacting the ground. The pair of top pieces includes a first top piece located on the first section of the heel piece in a location on the first section that forms the lowermost portion of the heel piece when the heel piece is rotated into the retracted configuration. Another top cap be located at a distal end of the second section to form the lowermost portion of the heel piece when the heel piece is rotated into the extended high heel configuration.

In one aspect, the housing may be constructed to conceal or hide the first top piece from view when the heel piece is rotated into the extended high heel configuration. Alternatively, the housing may be constructed to make the first top piece fully visible from a rear view when the heel piece is rotated into the extended high heel configuration.

DETAILED DESCRIPTION OF THE PREFERRED EMBODIMENT

Figure 1:
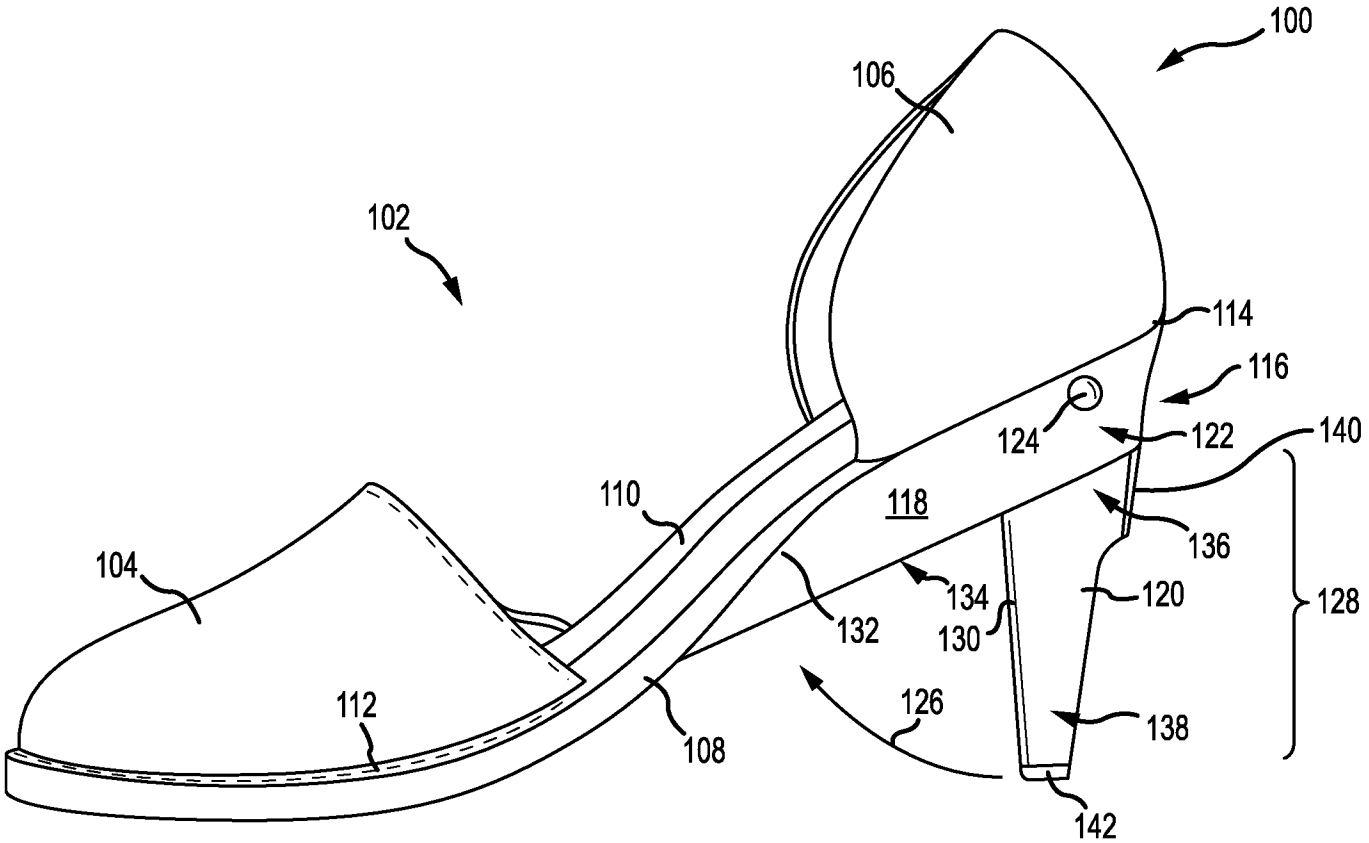
FIG. 1 shows a first embodiment of a women's shoe that includes a heel assembly with a pivot-latch mechanism where a pivotable heel piece of the shoe is in an extended high heel configuration.

FIG. 1 shows a dual use shoe 100 according to a first embodiment. The shoe 100 has an upper 102 including a vamp 104 and a heel section 106 that are each attached to a sole 108. The upper 102 generally conforms to the contours of a human foot when the shoe 100 is placed on the foot of a wearer. The upper 102 retains the shoe 100 on the foot when the shoe is in use. Other features include an optional gel insole 110 for the wearer's comfort. The upper 102 may be coupled directly or indirectly to the sole, for example, by stitching 112 and/or gluing 114.

The shoe 100 also includes a heel assembly 116 including a housing 118, a heel piece 120, and a pivoting latch mechanism 122 that is located on the lateral side of the shoe. Thus, a button 124 of the pivoting latch mechanism 122 is located on the outer side of the left foot, the right shoe being a mirror image of shoe 100. The heel assembly 116 may be attached to the outsole 132, for example, by the use of machine screws, gluing, nailing, riveting or ultrasonic welding.

Figure 2:
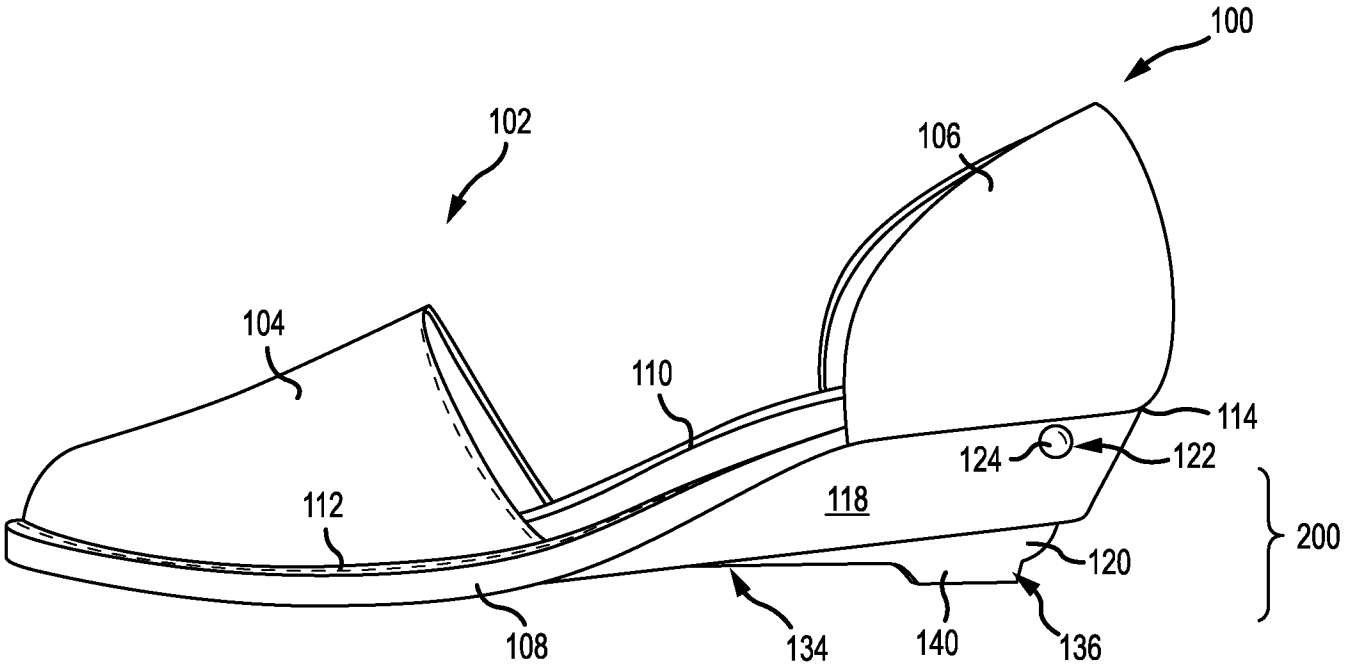
FIG. 2 shows the women's shoe with the heel piece in a retracted positon down beneath the sole of the shoe.

In FIG. 1, the pivoting latch mechanism 122 is visible as button 124. The heel piece 120 is shown in an extended high heel configuration 128, and the pivoting latch mechanism 122 locks the heel piece fully extend into the configuration 128. The lock is disrupted when the button 124 is manually depressed, permitting the heel piece 120 to rotate forward generally along arc 126 to place the heel piece in a retracted position with breast surface 130 proximate the outsole 132. As is shown in FIG. 2, a majority portion of the heel piece 120 is received within a receptacle 134 formed within the housing 118 in the retracted configuration 200, such that the heel piece 120 resides dominantly within the housing 118. As used herein, "dominantly received" means that a majority of the volume of heel piece 120 is received within the receptacle 134. This may be, for example, at least 51%, 60%, 70%, 80%, 90%, 95%, or 100% of the volume of heel piece 120.

The heel piece 120 has a first section 136 proximate the pivot latch mechanism 122 and a second section 138 remote from the pivot latch mechanism 122. The first section 136 has a first top cap 140 that presents as the lowest portion, i.e., ground contacting surface, of the heel piece 120 in the retracted configuration 200 of FIG. 2. The second section 138 has a second top cap 142 that presents as the lowest portion, i.e., ground contacting surface of the heel piece 120 in the extended high heel configuration 128 of FIG. 1. As shown in FIG. 1, the top cap 140 is visible at the rear of shoe 100 in the extended high heel configuration 128. The top cap 142 is partially or completely hidden from the side plan view in the retracted configuration 200 of FIG. 2 such that, in the event that the top cap 142 is subject to unsightly wear, this will not detract from the overall appearance of shoe 100 in the retracted configuration 200. The top caps 140, 142 may be integrally formed with the heel piece 120, or they may be mounted onto the heel piece 120 as separate components.

Figure 3B:
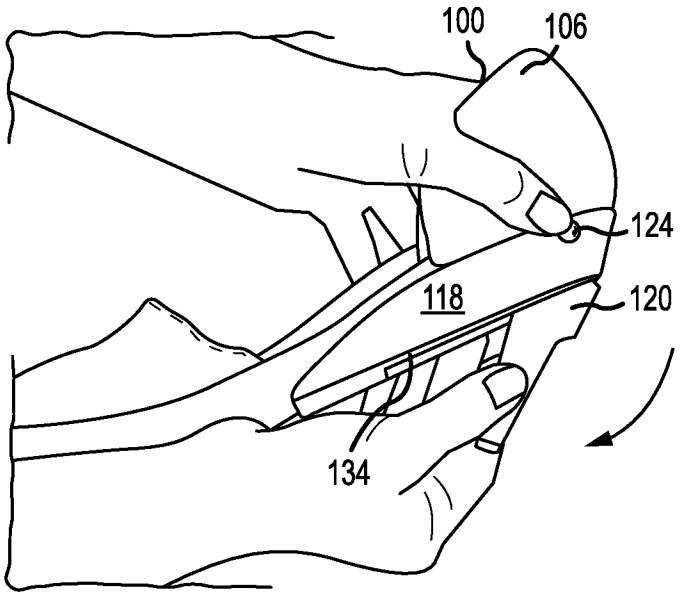
FIG. 3B shows manual manipulation of a button on the pivot-latch mechanism of the shoe that permits pivot motion of the heel piece against spring bias into the retracted positon of the heel piece.
Figure 3A:
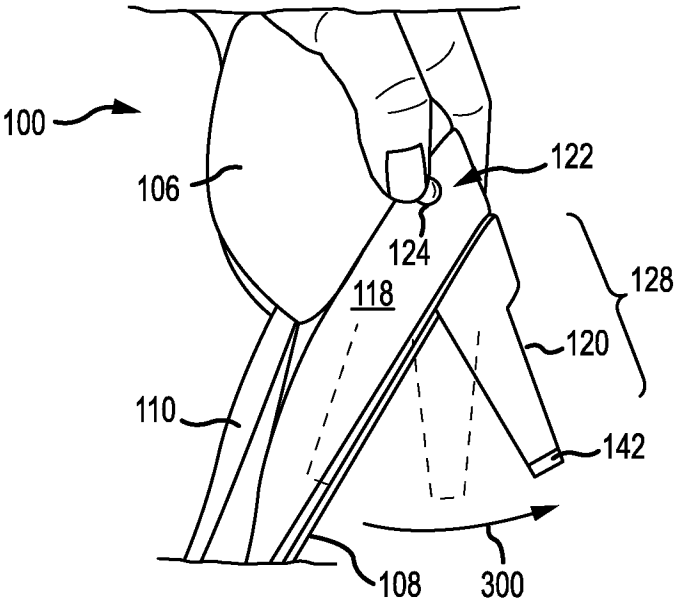
FIG. 3A shows manual manipulation of a button on the pivot-latch mechanism of the shoe with consequent release of the heel piece and pivoting into an the extended high heel configuration.

As shown in FIG. 3A, the pivot latch mechanism 122 includes an internal spring (not shown) that biases the heel piece 120 into the extended high heel configuration 128 (see FIG. 1). Thus, when the shoe is in the retracted configuration 200 (see FIG. 2), manual depression of pivot latch mechanism 122 releases the heel piece 120 from its lock. The bias of the internal spring causes the heel piece 120 to rotate in a radially outboard direction along arc 300 into the extended high heel configuration 128. Release of the button 124 when the heel piece 120 is in the extended high heel configuration 128 locks the heel piece 120 in that configuration. Conversely, as shown in FIG. 3B, depressing the button 124 when the shoe is in the extended high heel configuration 128 (see FIG. 1) releases the pivot latch mechanism 122 such that the heel piece 120 may be manually rotated radially inboard against spring bias into the retracted configuration 200 (see FIG. 2) where the heel piece 120 is dominantly received within the receptacle 134.

As shown in FIG. 1, the shoe 100 is styled as a ladies court shoe in the extended high heel configuration 128. The shoe 100 in the retracted configuration 200 of FIG. 2 has a lower height than the high heel configuration and may be of a different style, such as a wedge, loafer, mule, or sandal.

Figure 4:
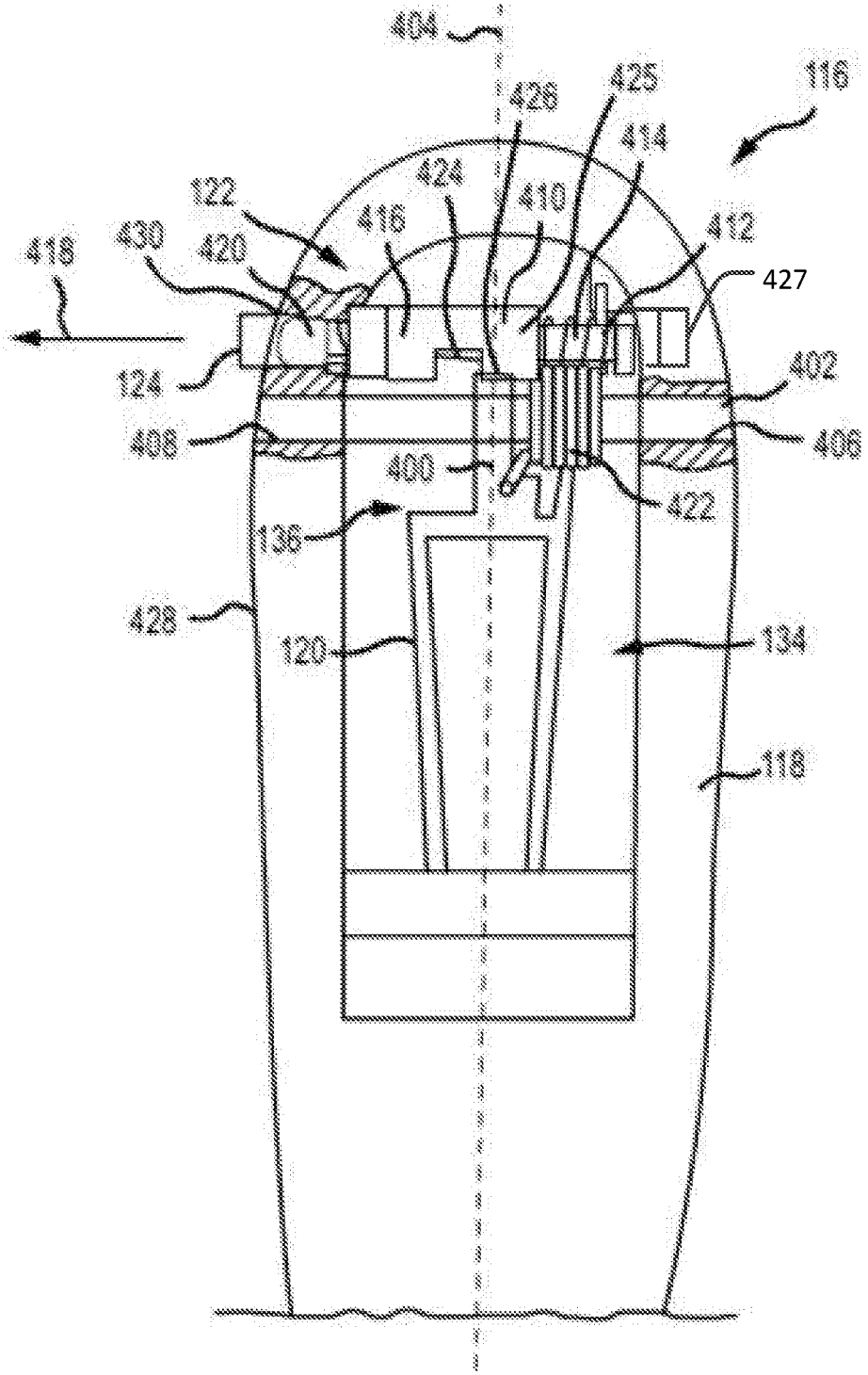
FIG. 4 is a top plan view of the heel assembly that shows the inner workings of the pivot patch mechanism.

FIG. 4 is a top plan view that shows the inner workings of the pivot latch mechanism 122 within the heel assembly 116. The pivot latch mechanism 122 of this embodiment is constructed as a two stage interference latch or bayonet latch. The first section 136 of the heel piece 120 includes an integrally formed rounder lobe 400 that is pivotally mounted on shaft 402. The shaft 402 runs generally perpendicular to a central elongate axis 404 forming the axis of elongation in the shoe. The central elongate axis 404 is generally in the same plane and either parallel to or coincident with the axis of elongation in the heel piece 120, such that pivoting of the heel piece 120 about shaft 402 occurs in the plane of the coincident axes. The shaft 402 may be compression-fit, glued or swaged into openings 406, 408, and may be made of the same material as is the housing 118 such that the shaft may be polished to blend in with the housing 118.

A catch member 410 is constructed to provide a close interference fit with various elements of lobe 400. As shown in FIG. 4, the heel piece 120 is in the retracted configuration 400. A compression spring 412 circumscribes a portion 414 of the catch member 410 that is of reduced diameter with respect to an integrally formed central slotted segment 416. The compression spring 412 biases the catch member 410 in the direction of arrow 418. A rounded nose segment 420, also of reduced diameter relative to the central slotted segment 416, resides within a complementary interior portion of button 124. Alternatively, the button 124 may be eliminated such that the rounded nose segment 420 serves in place of button 124. A torsion spring 422 biases the heel piece 120 for rotation into the extended high heel configuration 128 as discussed in context of FIG. 3A above. Thus, manually depressing the button 124 against the bias of compression spring 412 moves slot 424 towards lobe 400. Once lobe 400 is no longer confined by the interference fit of shoulder 425 of the slotted segment 416 abutting slot 426 of the lobe 400, the heel piece 120 is able to rotate out into the extended high heel configuration 128 (see FIG. 3). Portion 414 is received within hole 427 and may shift longitudinally therein. Abutment between lobe 400 and shoulder 425 retains the catch member 410 within holes 427, 430.

The button 124 and rounded nose segment 420 of the catch member 410 pass longitudinally through hole 430 of housing 118. In FIG. 4, certain portions of the housing 118 are shown with section lines indicating material that has been removed for purposes of illustration to reveal the openings 406, 408 and hole 430.

Figure 5A:
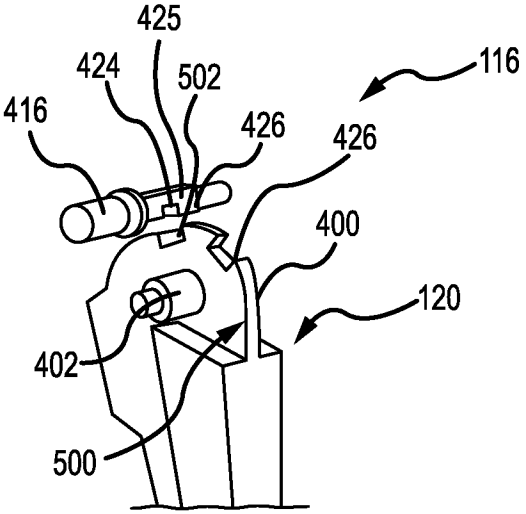
FIG. 5A provides additional detail with respect to a two stage bayonet latch forming a part of the pivot latch mechanism.
Figure 5C:
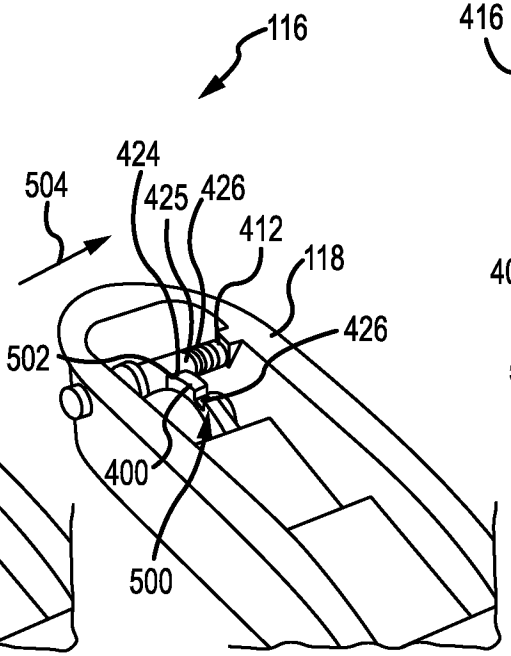
FIG. 5C shows the two stage bayonet latch in operation.
Figure 5B:
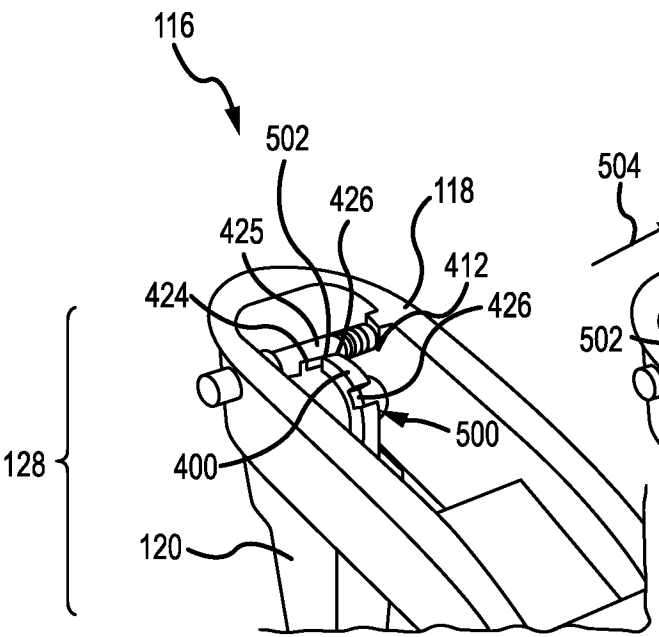
FIG. 5B shows the two stage bayonet latch in operation.

Releasing the button 124 when the heel piece 120 is in the extended high heel configuration 128 locks the heel piece 120 in place. FIG. 5A provides additional detail concerning the two stage bayonet latch mechanism for this. The lobe 400 is provided with two slots 426, 502. These slots may be selectively aligned with the shoulder 425 of the catch member 410 to lock the heel piece 120 in place. Slot 426 corresponds to the retracted configuration 200 when engaged with shoulder 425. Similarly, slot 502 corresponds to the extended high heel configuration when engaged with shoulder 425. As shown in FIG. 5B, the heel piece 120 is locked into the extended high heel configuration 128 because the shoulder 425 of the catch member 410 is contacting slot 502 of lobe 400. Depressing the catch member 410 against the bias of compression spring 412, as indicated by arrow 504 aligns slot 424 of the catch member 410 with the rounded portion of rounded periphery 500 of lobe 400, unlocking the heel piece 120 to permit rotation thereof into the retracted configuration 200 (see FIG. 2). Release of button 124 then causes the catch member 410 to shift opposite the direction of arrow 504 under the bias of compression spring 412, which locks the heel piece 120 into the retracted configuration 200 as the shoulder 424 abuts slot 426 to once again interfere with rotation of the heel piece 120 about shaft 402.

In this manner, the catch member 410 is being selectively shiftable 918 for placing the shoulder 425 thereof into and out of locking engagement with a selected one of the slots 426, 502 of the rounded lobe 400. The selective shifting 918 also aligns the slotted section 424 of the catch member 410 with the rounded periphery 500 of lobe 400 to permit free rotation thereof through the slotted section 424.

Figure 6:
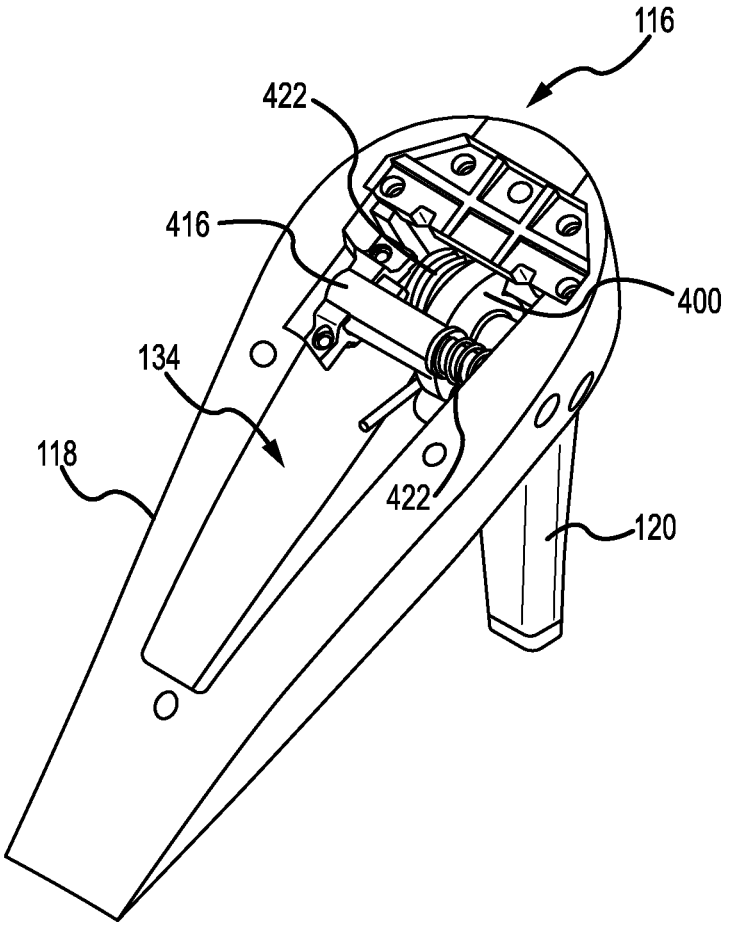
FIG. 6 is a perspective view of the pivot-latch mechanism.

It will be appreciated that FIGS. 4, 5A, 5B and 5C show the heel assembly 116 in a right shoe configuration such that the button 124 is located laterally on the outside right surface 428 (see FIG. 4) corresponding to a wearer's foot. FIG. 6 shows this same configuration in a front top perspective view. The heel assembly 116 of FIG. 6 is made ready for mounting on a sole, and may be manufactured as a separately salable unit.

Figure 7:
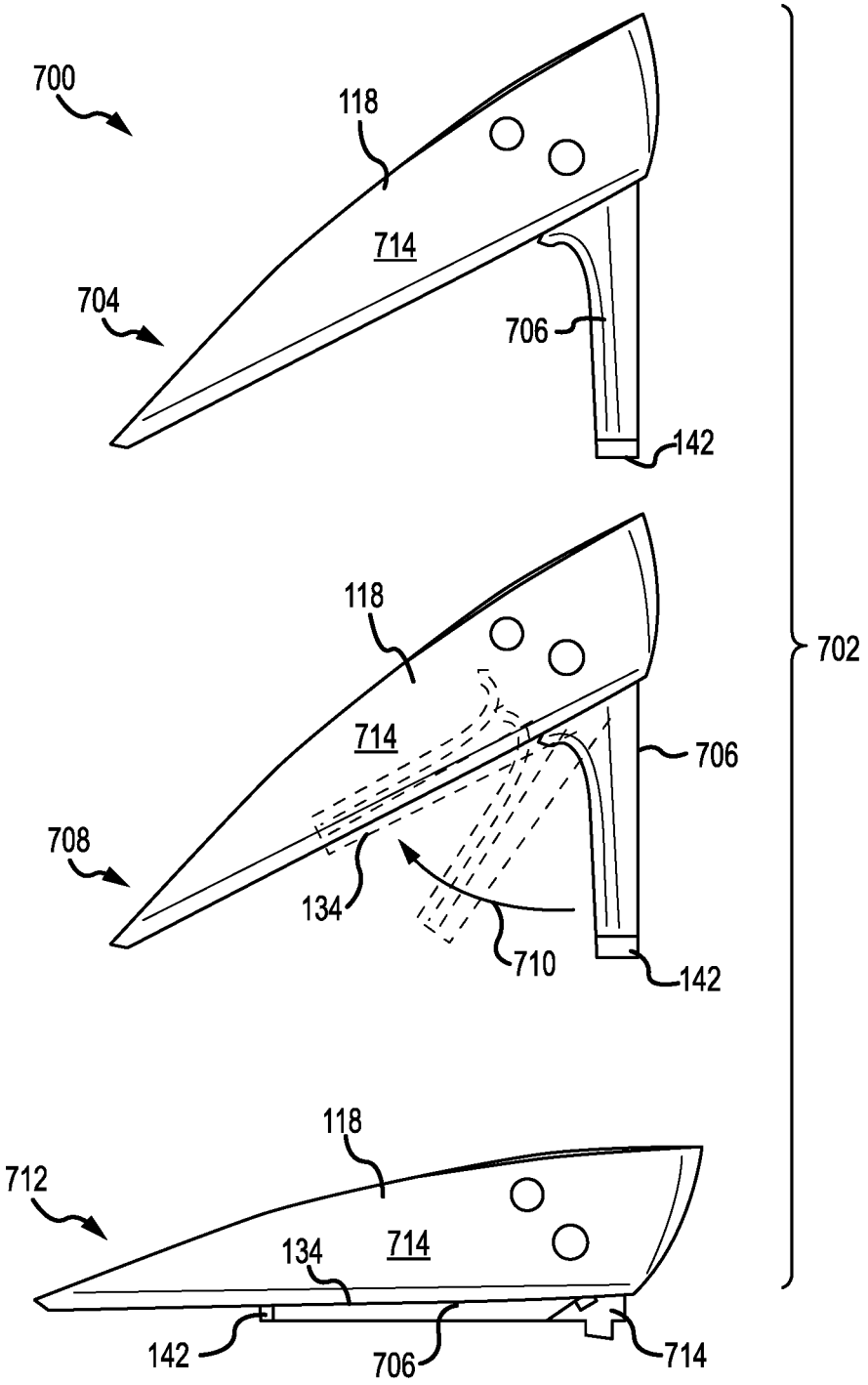
FIG. 7 shows a second embodiment of the women's shoe with an improved heel piece in various pivoting configurations.

FIG. 7 shows a dual use heel assembly 700 constituting a second embodiment of what is disclosed. The heel assembly 700 is shown in a series of configurations 702 including an extended high heel configuration 704 in which heel piece 706 is fully rotated and locked into a radially outboard location, a pivoting configuration 708 in which the heel piece 706 is unlocked and movable 710 towards the receptacle 134 of housing 118, and a retracted configuration 712 in which the heel piece 706 resides within receptacle 134 of the housing 118. The heel assembly 700 is identical to the heel assembly 116 as shown in FIG. 1, except for differences in the heel piece 702 as compared to the heel piece 120 of FIG. 1. Specifically, heel piece 702 differs from heel piece 120 in that heel piece 702 has a first top cap 714 which is hidden from exterior rear viewing when the heel assembly 700 is placed in the extended high heel configuration 704. This contrasts with the top cap 140 of FIG. 1, which is visible from the rear in the comparable extended high heel configuration 128. As shown in the retracted configuration 712 of FIG. 7, the second top cap 142 is not fully hidden from side viewing. In the alternative, the receptacle 134 may be optionally be constructed with a deeper sidewall 714 to hide one or both of: (1) top cap 142 in the retracted configuration 712 and (2) top cap 714 in the extended high heel configuration 704.

Figure 8A:
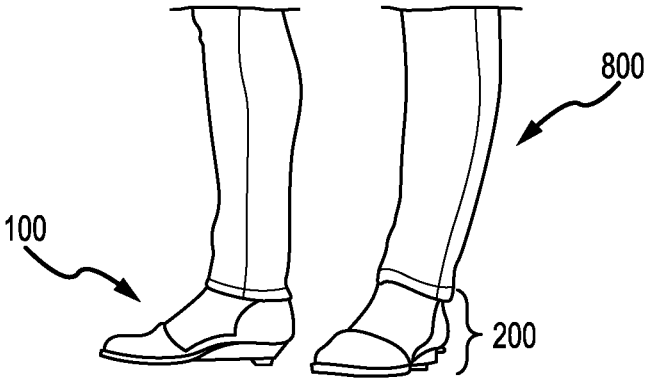
FIG. 8A shows a pair of the shoes, each with the heel piece in the in the retracted positon on the foot of a wearer.
Figure 8B:
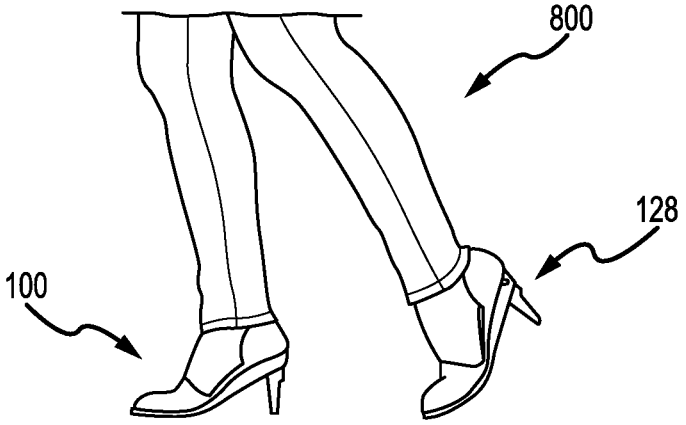
FIG. 8B shows the pair of shoes, each with the heel piece in the in the extended high heel configuration on the foot of a wearer.

By use of the instrumentalities described herein, as shown in FIGS. 8A and 8B, a wearer 800 may walk comfortably with shoes 100 in the retracted configuration 200 of FIG. 8A. At an appropriate time when an extended high heel configuration is desired, each of the shoes 100 may be converted into the extended high heel configuration of FIG. 8B by the expedient of depressing button 124 (see FIGS. 3A and 3B).

Figure 9:
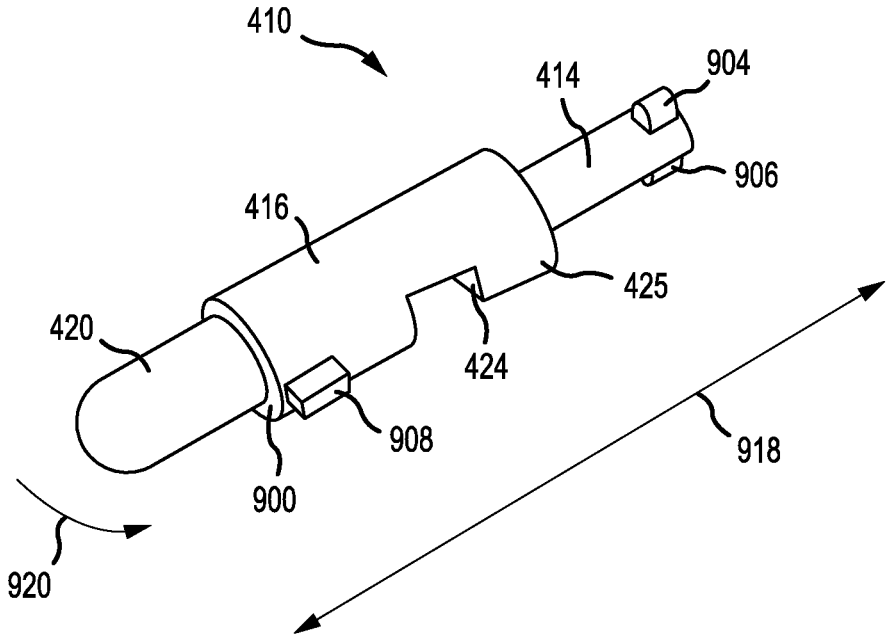
FIG. 9 provides additional detail with respect to a catch member for use in the pivot latch mechanism.

FIG. 9 provides additional detail with respect to the catch member 410. The rounded nose segment 420 is backed by a ledge 900 of relatively increased diameter that abuts structure surrounding the hole 43 (see FIG. 4) to prevent the catch member 410 from being ejected through hole 430 under the influence of the compression spring 412. The slot 902 is of complementary dimensions with respect to lobe 400, allowing passage of rounded portion 500 (see FIG. 5C) of lobe 400 to pass therethrough as the heel piece 120 is being pivoted. The shoulder 425 optionally includes a ramp of approximately 6° of increasing width away from the slot 902 towards portion 414. The increasing width of this ramp away from slot 425 provides close contact against slots 426, 502 (see FIG. 5) that eliminates play or jiggle of the heel piece 120 in the retracted position against slot 426, as well as the extended positon against slot 502. Stabilizing guides 904, 906, 908 permit longitudinal shifting 918 of the catch member 410 and prevent twisting 920 which could otherwise bring the slot 902 out of positional alignment with lobe 400.

Those skilled in the art will appreciate that the embodiments shown and described may be subjected to insubstantial changes without departing from the true scope and spirit of what is claimed as the invention. The inventor, accordingly, states her intentions to rely upon the Doctrine of Equivalents as needed in protecting her rights to the invention.

What is claimed is:

1. A dual use shoe comprising, a sole; an upper connected to the sole, the upper conforming to contours of a human toot that is to be received within the upper when the shoe is worn; and a heel assembly including a housing attached to the sole, the housing having a receptacle formed therein, a heel piece having a first section proximate the housing and a second section remote from the housing, a pivot-latch mechanism including at least a two-stage bayonet latch coupling the first section of the heel piece to the housing such that the pivot-latch mechanism may be selectively manipulated for pivoting of the heel piece between a radially inboard position where the heel piece is rotated and locked into a retracted configuration proximate the sole such that the heel piece predominantly resides within the receptacle; and a radially outboard position where the heel piece is rotated away from the sole into an extended high heel configuration such that the heel piece resides predominantly out of the receptacle.

2. The dual use shoe of claim 1, wherein the shoe in the extended high heel configuration is in a style known as a women's court shoe, and the shoe in the retracted configuration has a lower height than that of the high heel configuration and is selected from the group consisting of a wedge, a loafer, a mule, and a sandal.

3. The dual use shoe of claim 1, wherein the sole presents an elongate central axis running from a toe of the shoe to the heel assembly, and the heel piece presents an axis of elongation running from the first section to the second section, and the pivot-latch mechanism permits pivoting in a plane that is approximately coincident with the elongate central axis and the axis of elongation.

4. The dual use shoe of claim 1, wherein the two stage bayonet latch has a button for manual manipulation thereof, the button protruding from a side of the housing selected from the group consisting of a lateral side and a proximal side of a human foot when the shoe is being worn.

5. The dual use shoe of claim 4, wherein the side is the lateral side.

6. The dual use shoe of claim 4, wherein the pivot latch mechanism includes a spring that biases the heel piece into the extended high heel configuration such that spring rotates the heel piece into the extended high heel configuration after the button is depressed when the heel piece resides in the retracted configuration.

7. The dual use shoe of claim 1, wherein the two stage bayonet latch includes a catch member having a slotted section and a shoulder, and the heel piece having a rounded lobe with a rounded periphery and two slots each allocated to one of the extended high heel configuration and the retracted configuration, the catch member being selectively shiftable for placing the shoulder thereof into and out of locking engagement with a selected one of the slots of the rounded lobe, and aligning the slotted section of the catch member with the rounded periphery of the lobe to permit free rotation thereof through the slotted section.

8. The dual use shoe of claim 1, wherein the pivot-latch mechanism has a button for manual manipulation thereof, the button protruding from a side of the housing selected from the group consisting of a lateral side and a proximal side of a human foot when the shoe is being worn.

9. The dual use shoe of claim 8, wherein the side is the lateral side.

10. The dual use shoe of claim 1, wherein the heel piece has a pair of top pieces positioned for contacting the ground, the pair of top pieces including a first top piece located on the first section of the heel piece in a location on the first section forming the lowermost portion of the heel piece when the heel piece is rotated into the retracted configuration, and a second top cap located at a distal end of the second section to form the lowermost portion of the heel piece when the heel piece is rotated into the extended high heel configuration.

11. The dual use shoe of claim 10, wherein the first top piece is hidden from exterior view when the heel piece is rotated into the extended high heel configuration.

12. The dual use shoe of claim 10, wherein the second top piece is hidden from side view when the heel piece is in the retracted position.

13. A dual use shoe comprising, a sole; an upper connected to the sole, the upper conforming to contours of a human foot that is to be received within the upper when the shoe is worn; and a heel assembly including a housing attached to the sole, the housing having a receptacle formed therein, a heel piece having a first section proximate the housing and a second section remote from the housing; and means including at least a two-stage bayonet latch for coupling the first section of the heel piece to the housing such that the heel piece may be selectively pivoted between a radially inboard position where the heel piece is rotated and locked into a retracted configuration proximate the sole such that the heel piece predominantly resides within the receptacle; and a radially outboard position where the heel piece is rotated away from the sole into an extended high heel configuration such that the heel piece resides predominantly out of the receptacle.

14. The dual use shoe of claim 13, wherein the two stage bayonet latch has a button for manual manipulation thereof, the button protruding from a side of the housing selected from the group consisting of a lateral side and a proximal side of a human foot when the shoe is being worn.

15. The dual use shoe of claim 14, wherein the side is the lateral side.

16. The dual use shoe of claim 13, wherein the two stage bayonet latch includes a catch member having a slotted section and a shoulder, and the heel piece having a rounded lobe with a rounded periphery and two slots formed therein, each of the slots being allocated to one of the extended high heel configuration and the retracted configuration, the catch member being selectively shiftable for placing the shoulder thereof into and out of locking engagement with a selected one of the slots of the rounded lobe, and aligning the slotted section of the catch member with the rounded periphery of the lobe to permit free rotation thereof through the slotted section.

17. The dual use shoe of claim 13, wherein the means for coupling has a button for manual manipulation thereof, the button protruding from a side of the housing selected from the group consisting of a lateral side and a proximal side of a human foot when the shoe is being worn.

18. The dual use shoe of claim 17, wherein the side is the lateral side.

19. The dual use shoe of claim 17, wherein the means for coupling further includes a spring that biases the heel piece into the extended high heel configuration such that spring rotates the heel piece into the extended high heel configuration after the button is depressed when the heel piece resides in the retracted configuration.

20. The dual use shoe of claim 15, wherein the heel piece has a pair of top pieces positioned for contacting the ground, the pair of top pieces including a first top piece located on the first section of the heel piece in a location on the first section forming the lowermost portion of the heel piece when the heel piece is rotated into the retracted configuration, and a second top cap located at a distal end of the second section to form the lowermost portion of the heel piece when the heel piece is rotated into the extended high heel configuration.

21. The dual use shoe of claim 20, wherein the first top piece is hidden from exterior view when the heel piece is rotated into the extended high heel configuration.

22. The dual use shoe of claim 20, wherein the second top piece is hidden from side view when the heel piece is in the retracted position.

23. In a women's shoe having a sole and an upper, the improvement comprising: a heel assembly including a sole, a heel piece having a first section a housing mounted on the sole, the housing defining a receptacle of complementary dimensions for receipt of the heel piece therein; and a pivot latch mechanism including at least a two-stage bayonet latch for coupling the first section of the heel piece to the housing such that the pivot-latch mechanism may be selectively manipulated for pivoting of the heel piece between a radially inboard position where the heel piece is rotated and locked into a retracted configuration proximate the sole such that the heel piece predominantly resides within the receptacle; and a radially outboard position where the heel piece is rotated away from the sole into an extended high heel configuration such that the heel piece resides predominantly outside of the receptacle.

24. The dual use shoe of claim 23, wherein the improvement further comprises the two stage bayonet latch having a button for manual manipulation thereof, the button protruding from a side of the housing selected from the group consisting of a lateral side and a proximal side of a human foot when the shoe is being worn.

25. The dual use shoe of claim 24, wherein the side is the lateral side.

26. The dual use shoe of claim 23, wherein the improvement further comprises the two stage bayonet latch including a catch member having a slotted section and a shoulder, and the heel piece having a rounded lobe with a rounded periphery and two slots formed therein, each of the slots being allocated to one of the extended high heel configuration and the retracted configuration, the catch member being selectively shiftable for placing the shoulder thereof into and out of locking engagement with a selected one of the slots of the rounded lobe, and aligning the slotted section of the catch member with the rounded periphery of the lobe to permit free rotation thereof through the slotted section.

27. The dual use shoe of claim 23, wherein the improvement further comprises the pivot-latch mechanism having a button for manual manipulation thereof, the button protruding from a side of the housing selected from the group consisting of a lateral side and a proximal side of a human foot when the shoe is being worn.

28. The dual use shoe of claim 27, wherein the side is the lateral side.

29. The dual use shoe of claim 27, wherein the improvement further comprises the pivot latch mechanism including a spring that biases the heel piece into the extended high heel configuration such that spring rotates the heel piece into the extended high heel configuration after the button is depressed when the heel piece resides in the retracted configuration.

30. The dual use shoe of claim 23, wherein the improvement further comprises the heel piece having a pair of top pieces positioned for contacting the ground, the pair of top pieces including a first top piece located on the first section of the heel piece in a location on the first section forming the lowermost portion of the heel piece when the heel piece is rotated into the retracted configuration, and a second top cap located at a distal end of the second section to form the lowermost portion of the heel piece when the heel piece is rotated into the extended high heel configuration.

31. The dual use shoe of claim 30, wherein the first top piece is hidden from exterior view when the heel piece is rotated into the extended high heel configuration.

32. The dual use shoe of claim 30, wherein the second top piece is hidden from side view when the heel piece is in the retracted position.

33. A heel assembly comprising, a heel piece having a first section, a housing having a receptacle formed therein, the receptacle having compatible dimensions for receipt of the heel piece therein; a pivot latch mechanism including at least a two-stage bayonet latch for coupling the first section of the heel piece to the housing such that the pivot-latch mechanism may be selectively manipulated for pivoting of the heel piece between a radially inboard position where the heel piece is rotated and locked into a retracted configuration such that the heel piece predominantly resides within the receptacle; and a radially outboard position where the heel piece is rotated away from the sole into an extended high heel configuration such that the heel piece resides predominantly outside of the receptacle.

34. The heel assembly of claim 33, wherein the pivot latch mechanism includes a spring that biases the heel piece into the extended high heel configuration such that spring rotates the heel piece into the extended high heel configuration after the button is depressed when the heel piece resides in the retracted configuration.

35. The dual use shoe of claim 33, wherein the two stage bayonet latch includes a catch member having a slotted section and a shoulder, and the heel piece having a rounded lobe with a rounded periphery and two slots formed therein, each of the slots being allocated to one of the extended high heel configuration and the retracted configuration, the catch member being selectively shiftable for placing the shoulder thereof into and out of locking engagement with a selected one of the slots of the rounded lobe, and aligning the slotted section of the catch member with the rounded periphery of the lobe to permit free rotation thereof through the slotted section.

36. The heel assembly of claim 33, wherein the heel piece has a pair of top pieces for contacting the ground, the pair of top pieces including a first top piece located on the first section of the heel piece in a location on the first section forming the lowermost portion of the heel piece when the heel piece is rotated into the retracted configuration, and a second top cap located at a distal end of the second section to form the lowermost portion of the heel piece when the heel piece is rotated into the extended high heel configuration.

37. The heel assembly of claim 36, wherein the first top piece is hidden from exterior view when the heel piece is rotated into the extended high heel configuration.

38. The heel assembly of claim 36, wherein the second top piece is hidden from side view when the heel piece is in the retracted position.

* * * * *